US009239551B2

(12) United States Patent
Omata

(10) Patent No.: US 9,239,551 B2
(45) Date of Patent: Jan. 19, 2016

(54) IMAGE FORMING APPARATUS

(71) Applicant: CANON KABUSHIKI KAISHA, Tokyo (JP)

(72) Inventor: Haruhiko Omata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/672,469

(22) Filed: Mar. 30, 2015

(65) Prior Publication Data

US 2015/0286167 A1 Oct. 8, 2015

(30) Foreign Application Priority Data

Apr. 7, 2014 (JP) ..... 2014-078575

(51) Int. Cl.
*G03G 15/16* (2006.01)

(52) U.S. Cl.
CPC ..... *G03G 15/1665* (2013.01)

(58) Field of Classification Search
CPC ..... G03G 15/1665
USPC ..... 399/316, 302, 308, 312, 313
See application file for complete search history.

(56) References Cited

U.S. PATENT DOCUMENTS

| | | | | |
|---|---|---|---|---|
| 6,697,595 | B2 | 2/2004 | Kawagoe et al. | |
| 8,295,746 | B2 * | 10/2012 | Matsumoto | 399/302 |
| 8,787,805 | B2 | 7/2014 | Nakajima | |
| 8,818,249 | B2 | 8/2014 | Kaseda | |
| 2002/0034406 | A1 * | 3/2002 | Kawagoe et al. | 399/302 |
| 2006/0104651 | A1 * | 5/2006 | DiRubio et al. | |
| 2014/0294452 | A1 * | 10/2014 | Yagata | 399/302 |

FOREIGN PATENT DOCUMENTS

| | | | |
|---|---|---|---|
| JP | 2002-082543 | A | 3/2002 |
| JP | 2005-274863 | A | 10/2005 |
| JP | 2012-073537 | A | 4/2012 |
| JP | 2012-168396 | A | 9/2012 |

* cited by examiner

*Primary Examiner* — Susan Lee
(74) *Attorney, Agent, or Firm* — Fitzpatrick, Cella, Harper & Scinto

(57) ABSTRACT

A conveying belt is disposed so as to guide a recording medium on a side opposite to an image carrying belt across an extension line of a stretch surface formed by a transfer nip and a pressure member. Thus, the recording medium delivered from the transfer nip is guided on the side opposite to the image carrying belt across the extension line of the stretch surface. Therefore, even in a case of guiding a recording medium whose bending rigidity is high in particular, it is possible to suppress a rear end of the recording medium to move in a direction of separating from the image carrying belt at upstream of the transfer nip.

5 Claims, 3 Drawing Sheets

IMAGE FORMING APPARATUS

BACKGROUND OF THE INVENTION

1. Field of the Invention

The present invention relates to an image forming apparatus configured to transfer a toner image carried on an image carrier to a recording medium by using electro-photographic technology.

2. Description of the Related Art

Hitherto, there is known an image forming apparatus configured to transfer a toner image carried on an rotating endless belt-like intermediate transfer body (referred to as an 'intermediate transfer belt' hereinafter) to a recording medium at a transfer nip where the transfer belt is brought into contact with a transfer rotating member, e.g., transfer belt or a transfer roller. A strong electric field is generated at the transfer nip because high voltage is applied to the transfer rotating member to transfer the toner image from the intermediate transfer belt to the recording medium.

By the way, there is a case when the intermediate transfer belt vibrates during its rotation. If the intermediate transfer belt vibrates, a gap can be generated between a toner image carrying surface of the intermediate transfer belt and a recording medium at upstream of the transfer nip (upstream side in the conveying direction of the recording medium). Because the strong electric field is generated at the transfer nip as described above, an abnormal discharge tends to occur between the intermediate transfer belt and the recording medium if the gap is generated at upstream of the transfer nip. If the abnormal discharge occurs, the electrical charge of the toner carried on the intermediate transfer belt is lost and the toner whose electrical charge is lost is not transferred from the intermediate transfer belt to the recording medium. Then, a defective image in which an image of a spot where the abnormal discharge has occurred is omitted (called as a 'void' or the like) is generated.

Then, Japanese Patent Application Laid-open No. 2002-82543 discloses a device that suppresses the vibration of the intermediate transfer belt causing the abnormal discharge by disposing a vibration preventing member on a back surface side (side opposite to the toner image carrying surface) of the intermediate transfer belt and by pressing the intermediate transfer belt from the back surface thereof. This arrangement makes it possible to deliver the recording medium to the transfer nip in a state in which the recording medium is adhered to the toner image carrying surface of the intermediate transfer belt without gap at upstream of the transfer nip.

In the image forming apparatus, the recording medium on which the toner image has been transferred is delivered downstream of the transfer nip (downstream in the conveying direction of the recording medium) and is guided to a fixing apparatus in a state in which an opposite side from the surface on which the toner image has been transferred is supported by a conveying belt, a conveying guide, or the like. A direction in which the recording medium is guided is determined in accordance to a position where the fixing apparatus is disposed. For instance, in a case when the fixing apparatus is disposed obliquely upward from a direction in which the recording medium is delivered from the transfer nip, the conveying belt guides the recording medium so as to uplift a front end of the recording medium obliquely upward toward the fixing apparatus.

However, there is a problem in the past that the void caused by the abovementioned abnormal discharge is apt to be generated in guiding a recording medium whose bending rigidity is high such as a thick sheet, a coated sheet or the like. That is, if a 'stiff' recording medium is guided in a state in which its front end is uplifted at downstream of the transfer nip, a rear end of the recording medium moves in a direction separating from the intermediate transfer belt at upstream of the transfer nip. Then, the gap is generated between the toner image carrying surface of the intermediate transfer belt and the recording medium, thus causing the abnormal discharge and the void at the spot where the gap is generated.

SUMMARY OF THE INVENTION

According to an aspect of the present invention, an image forming apparatus includes an endless image carrying belt moving while carrying a toner image, a transfer rotating member forming a transfer nip with the image carrying belt and transferring the toner image from the image carrying belt to a recording medium, a pressure member provided adjacent to and upstream, in a moving direction of the image carrying belt, of the transfer nip and pressing the image carrying belt from an inner circumferential surface thereof, and a guide portion disposed downstream, in the moving direction of the image carrying belt, of the transfer nip on a side opposite to the image carrying belt across an extension line of the stretch surface formed by the transfer nip and the pressure member at upstream of the transfer nip, and guiding the recording medium conveyed downstream from the transfer nip.

Further features of the present invention will become apparent from the following description of exemplary embodiments (with reference to the attached drawings).

DESCRIPTION OF THE EMBODIMENTS

An embodiment of the present invention will be explained in detail below with reference to the drawings. The present invention can be carried out by another embodiment in which a part or whole of a configuration of the present embodiment is replaced with its substitute configuration as long as it is configured such that a vibration preventing member presses an intermediate transfer belt from a back surface thereof (side opposite to a toner image carrying surface) to suppress vibration of the intermediate transfer belt.

Accordingly, the present invention can be carried out as long as the image forming apparatus uses the intermediate transfer belt, regardless of a type thereof such as a tandem type/one drum type, an electrification type, an electrostatic image forming type, a development type, a transfer type, and a fixing type. While only a main part concerning to a toner image forming and/or transferring operation will be described in the present embodiment, the present invention can be carried out in various uses such as a printer, any of various printing machines, a copier, a facsimile machine, a multi-function printer and others by adding a necessary device, an attachment and a casing structure.

<Image Forming Apparatus>

Figure 1:
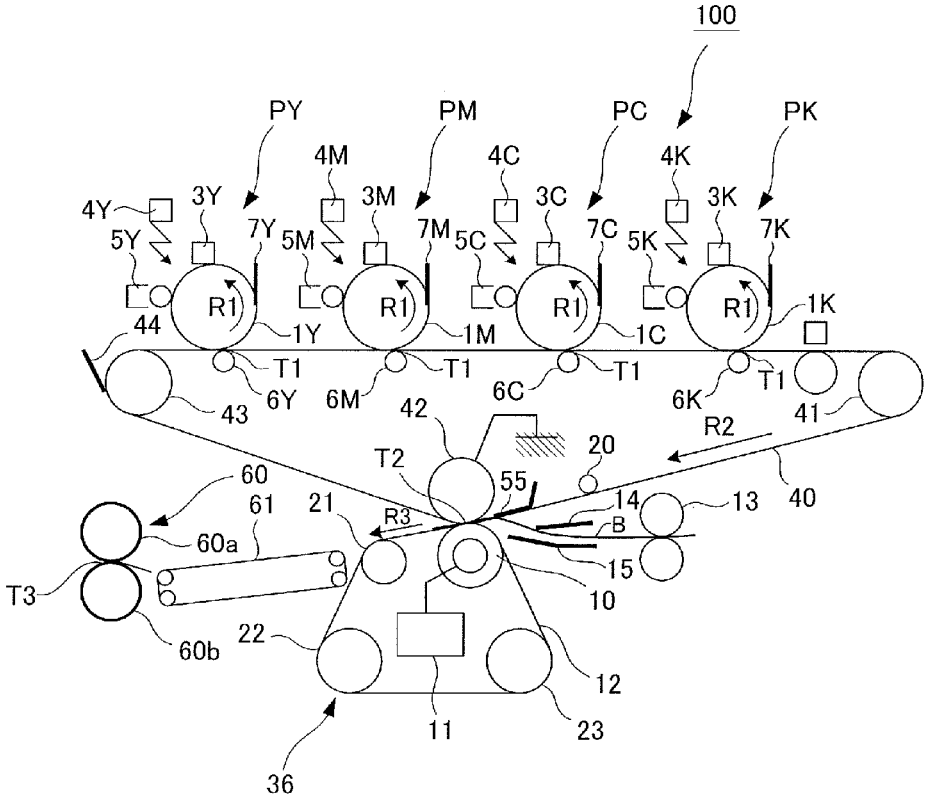
FIG. 1 is a schematic diagram illustrating a configuration of an image forming apparatus according to an embodiment of the invention.

FIG. 1 is a diagram schematically showing a configuration of the image forming apparatus 100 of the present embodiment of the invention. As shown in FIG. 1, the image forming apparatus 100 is a tandem intermediate transfer type full-color printer in which image forming portions PY, PM, PC, and PK corresponding yellow, magenta, cyan and black are arrayed along an intermediate transfer belt 40.

In the image forming portion PY, a yellow toner image is formed on a photosensitive drum 1Y and is then (primarily) transferred to the intermediate transfer belt 40. In the image forming portion PM, a magenta toner image is formed on a photosensitive drum 1M and is then transferred to the intermediate transfer belt 40. In the image forming portions PC and PK, cyan and black toner images are formed respectively on photosensitive drums 1C and 1K and are then sequentially transferred and superimposed to the intermediate transfer belt 40.

The image forming portions PY, PM, PC, and PK have substantially the same configuration except of that colors of toners used in developing apparatuses 5Y, 5M, 5C, and 5K are different and are yellow, magenta, cyan and black, respectively. Accordingly, the following explanation will be made on configurations and operations of the image forming portions PY, PM, PC, and PK collectively by denoting components thereof by reference numerals from which Y, M, C, and K discriminating the image forming portions PM, PC, and PK are omitted.

Each of the image forming portions PY, PM, PC, and PK includes a corona charger 3, an exposure apparatus 4, the developing apparatus 5, a transfer roller 6, and a drum cleaning device 7 centering on the photosensitive drum 1. The photosensitive drum 1 has a photosensitive layer formed around an outer circumferential surface thereof and rotates in a direction of an arrow R1 in FIG. 1 at a predetermined process speed.

The corona charger 3 electrifies a surface of the photosensitive drum 1 with homogeneous negative dark part potential by irradiating charged particles caused by corona discharge. The exposure apparatus 4 scans, by a rotational mirror, a laser beam generated by ON-OFF modulating scan line image data developed from a color separation image of each color to draw an electrostatic latent image on the surface of the electrified photosensitive drum 1. Because the electrostatic latent image drawn to the photosensitive drum 1 by the exposure apparatus 4 is an aggregate of small dot images, it is possible to change concentration of a toner image formed on the surface of the photosensitive drum 1 by changing density of the dot images. For instance, a maximum density of a toner image of each color is around 1.5 to 1.7 and a toner applied amount in the maximum density is around 0.4 to 1.6 mg/cm$^2$.

The developing apparatus 5 supplies toner to the photosensitive drum 1 to develop the electrostatic latent image as a toner image. The developing apparatus 5 rotates a developing sleeve not shown and disposed, while leaving a slight gap, on the surface of the photosensitive drum 1 in a counter direction of the photosensitive drum 1. The developing apparatus 5 electrifies a two-component developer containing toner and carrier and conveys to a part facing to the photosensitive drum 1 by carrying on the developing sleeve. Vibration voltage in which AC voltage is superimposed on DC voltage is applied to the developing sleeve and then the non-magnetic toner negatively electrified is transferred to an exposed part of the photosensitive drum 1 which has become relatively positive. Then, the electrostatic latent image is reversely developed.

The primary transfer roller 6 is in pressure contact with the intermediate transfer belt 40 and forms a primary transfer portion (nip) T1 between the photosensitive drum 1 and the intermediate transfer belt 40. In response to a positive DC voltage applied to the primary transfer roller 6, the negative toner image carried on the photosensitive drum 1 is transferred to the intermediate transfer belt 40. The primary transfer roller 6 disposed to face to the photosensitive drum 1 comes into contact with the intermediate transfer belt 40 with a total load of 10 N (1 kgf) for example and rotates following the intermediate transfer belt 40. A roller member in which an elastic layer of semi-conductive polyurethane foaming rubber is formed around a metallic shaft is used as the primary transfer roller 6. An Asker C hardness of a circumferential surface thereof is 10 and roller resistance is $1\times10^6\Omega$. The roller resistance of the primary transfer roller 6 is calculated by placing weights of 500 g each on both ends of the metallic shaft of the primary transfer roller 6, pressing a metal plate earthed through an ampere meter to the primary transfer roller 6, applying a voltage of 2 kV to one end of the metallic shaft, and finding a current flowing through the metallic shaft in an environment of 23° C. of temperature and 50% RH of relative humidity.

The cleaning device 7 recovers transfer residual toner remaining on the surface of the photosensitive drum 1 that has passed through the primary transfer portion T1 by bringing a cleaning blade in sliding contact with the photosensitive drum 1. The cleaning blade is made of a polyurethane material whose durometer hardness is 70 and whose thickness is 2 mm.

<Intermediate Transfer Belt>

The intermediate transfer belt 40 is an endless belt-like intermediate transfer body, i.e, an image carrying belt, rotating in contact with the photosensitive drum 1 and rotates in a direction of an arrow R2 in FIG. 1 at 250 to 300 mm/sec. The intermediate transfer belt 40 is made of a resin material and is stretched to a constant tension by a tension roller 41, a secondary transfer inner roller 42, and a driving roller 43. For instance, a force pushing the intermediate transfer belt 40 from the back surface to the front surface thereof is applied to the tension roller 41 by an elastic member such as a spring not shown and the intermediate transfer belt 40 is stretched by a tension of around 2 to 5 kg. It is noted that the back surface of the intermediate transfer belt 40 means a surface on a side opposite to the surface carrying the toner image (toner image carrying surface) of the intermediate transfer belt 40.

The intermediate transfer belt 40 is an endless belt having a three-layered structure in which a resin layer, an elastic layer, and a surface layer are sequentially formed from the back surface side. For instance, a resin material such as polyamide, polycarbonate or the like is used for the resin layer of 70 to 100 μm thickness. An elastic material such as urethane rubber, chloroprene rubber or the like is used for the elastic layer of 200 to 250 μm thickness. A material whose toner adhesion power to the surface of the intermediate transfer belt 40 is small and which enables toner to be readily transferred to the recording medium B in a secondary transfer nip T2 is used for the surface layer. For instance, either one resin material among polyurethane, polyester, epoxy resin and the like is used for the surface layer. Or, two or more types of elastic materials among elastic rubber, elastomer, butyl rubber and the like are used for the surface layer. In the case when the elastic material is used, it is preferable to use a material which reduces surface energy and enhances lubrication, e.g., a material in which one or two or more types of powders, particles of which are of different particle sizes and formed of fluororesin, are dispersed or blended. The surface layer is formed such that its thickness is 5 to 10 μm. Still further, volume resistivity of the intermediate transfer belt 40 is modified to $1\times10^9$ to $1\times10^{14}$ [Ω·cm] by adding a resistance value modifying conductive agent such as carbon black.

The registration roller 13 delivers the recording medium B to the secondary transfer nip T2, i.e., a transfer nip portion, while synchronizing with the toner image on the intermediate transfer belt 40. Disposed so as to face with each other along a conveying path to which the registration roller 13 delivers the recording medium B are upper and lower guides 14 and 15. That is, the recording medium B is delivered between the upper and lower guides 14 and 15. The upper and lower guides 14 and 15, i.e., guide members, restrict a moving direction of the recording medium B delivered by the registration roller 13. The upper guide 14 restricts movement of the recording medium B toward the intermediate transfer belt 40 and the lower guide 15 restricts movement of the recording medium B separating from the intermediate transfer belt 40. Thus, a guide path of the recording medium B from the registration roller 13 to the secondary transfer nip T2 is determined.

The four color toner images carried on the intermediate transfer belt 40 are conveyed to the secondary transfer nip T2 and are collectively and secondarily transferred to the recording medium B at the secondary transfer nip T2. A secondary transfer belt 12 conveys and passes the recording medium B through the secondary transfer nip T2 while matching with the toner image on the intermediate transfer belt 40. The recording medium B on which the four color toner images have been secondarily transferred at the secondary transfer nip T2 is delivered from the secondary transfer nip T2 to a conveying belt 61. The conveying belt 61 guides the recording medium B delivered from the secondary transfer nip T2 to a fixing apparatus 60 while supporting a surface opposite to the surface on which the toner image has been transferred.

The fixing apparatus 60, i.e., a fixing portion, forms a fixing nip T3, i.e., a fixing nip portion, by bringing two rotating bodies 60*a* and 60*b* into contact with each other and fixes the toner image on the recording medium B while conveying the recording medium B through the fixing nip T3. In the fixing apparatus 60, the fixing nip T3 is formed by bringing the pressure roller 60*b* into pressure contact with the heating roller 60*a* heated by a lamp heater or the like not shown from an inside thereof by a bias mechanism not shown. Heat and pressure are applied to the recording medium B and the toner image is fixed to the recording medium B which is conveyed while being nipped through the fixing nip T3. The recording medium B on which the toner image has been fixed by the fixing apparatus 60 is discharged out of the apparatus.

The belt cleaning device 44 recovers transfer residual toner remaining on the intermediate transfer belt 40 that has passed through the secondary transfer nip T2 by bringing a cleaning blade not shown in sliding contact with the intermediate transfer belt 40. The belt cleaning device 40 brings a tip of the cleaning blade made of polyurethane whose durometer hardness is 75 and whose thickness is 2 mm into contact with the surface of the intermediate transfer belt 40 in a counter direction. Beside recovering the transfer residual toner on the intermediate transfer belt 40 that has passed through the secondary transfer nip T2 without being transferred to the recording medium B, the belt cleaning device 44 also removes paper dusts and others adhering from the recording medium B to the intermediate transfer belt 40 at the secondary transfer nip T2 from the intermediate transfer belt 40.

<Secondary Transfer Belt Unit>

The secondary transfer belt unit 36, i.e., the transfer rotating member, includes a secondary transfer belt 12, a secondary transfer roller 10, a stretch roller 21, a driving roller 22 and a tension roller 23. The secondary transfer belt 12 comes in contact with the intermediate transfer belt 40 and forms the secondary transfer nip T2. Because a transfer electrical field is generated in the secondary transfer nip T2, the toner image on the intermediate transfer belt 40 is transferred to the recording medium B. The secondary transfer belt 12 is formed as an endless belt by using a high-resistant resin material and is stretched by the secondary transfer roller 10, the stretch roller 21, the driving roller 22, and the tension roller 23. The secondary transfer belt 12 rotates in a direction of an arrow R3 in FIG. 1 in synchronism with the intermediate transfer belt 40 and conveys the recording medium B delivered by the registration roller 13 to the conveying belt 61 side by passing through the secondary transfer nip T2. The secondary transfer belt 12 adheres with the recording medium B by being electrified when the toner image on the intermediate transfer belt 40 is transferred to the recording medium B, separates the recording medium B carrying the non-fixed toner image from the intermediate transfer belt 40, and delivers to the conveying belt 61.

The secondary transfer roller 10 is disposed at a position shifted by 0 to 4 mm upstream in the rotation direction of the intermediate transfer belt 40 with respect to the secondary transfer inner roller 42. The secondary transfer roller 10 is in pressure contact with the secondary transfer inner roller 42 through the intermediary of the intermediate transfer belt 40 and the secondary transfer belt 12 and forms the secondary transfer nip T2 between the intermediate transfer belt 40 and the secondary transfer belt 12.

The secondary transfer roller 10 is formed of a roller member in which an ion conductive foaming rubber (NBR rubber) is formed around a metal shaft as the elastic layer. An Asker-C hardness of the outer circumferential surface is 30 to 40 and a roller resistance is $1\times10^5$ to $1\times10^7\Omega$. This configuration is made so that the secondary transfer roller 10 can deform and come into contact with the secondary transfer inner roller 42 and the intermediate transfer belt 40. It is noted that an outer diameter of the secondary transfer roller 10 is 24 mm for example and surface roughness of the secondary transfer roller 10 is 6.0 to 12.0 μm for example. Still further, a pressure of the secondary transfer roller 10 in contact with the secondary transfer inner roller 42 is about 50 N.

The secondary transfer roller 10 is attached with a secondary transfer high-voltage power supply 11 whose supply bias is variable. The transfer electric field is generated at the secondary transfer nip T2 by a positive voltage (secondary transfer voltage) whose polarity is reverse to that of the toner and applied to the secondary transfer roller 10 by the secondary transfer high-voltage power supply 11 while connecting the secondary transfer inner roller 42 to the ground potential (0 V). In response to the transfer electric field, the negative toner images of yellow, magenta, cyan, and black carried on the intermediate transfer belt 40 are transferred collectively and secondarily to the recording medium B. Then, the recording medium B is adsorbed to the secondary transfer belt 12 by static electricity generated in the secondary transfer belt 12 by the application of the secondary transfer voltage. The recording medium B adsorbed on the surface of the secondary transfer belt 12 is separated from the surface of the secondary transfer belt 12 by a curvature of a curved surface of the secondary transfer belt 12 along the stretch roller 21 provided downstream in the conveying direction of the recording medium B and is passed to the conveying belt 61.

<Vibration Preventing Member>

Figure 2:
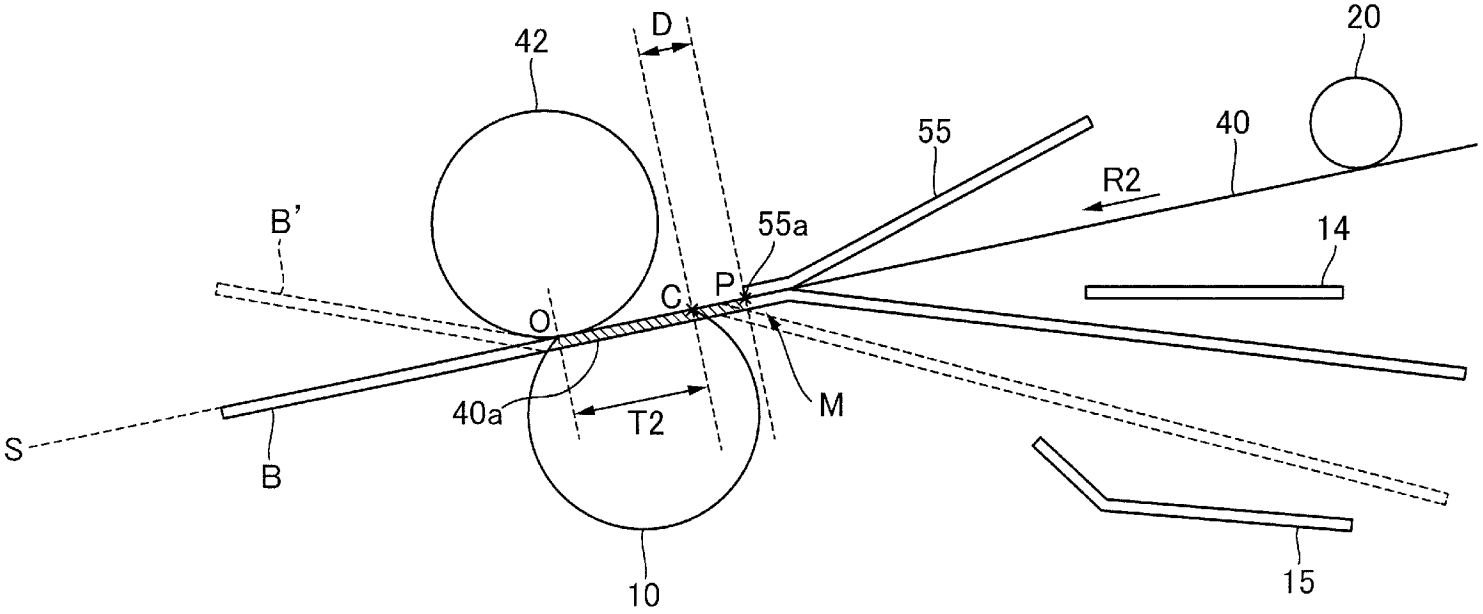
FIG. 2 illustrates a vibration preventing member of the embodiment.

The image forming apparatus 100 of the present embodiment is provided with a vibration preventing member 55 fixedly disposed upstream, in the rotation direction of the intermediate transfer belt 40, of the secondary transfer nip T2 to press the back surface of the intermediate transfer belt 40 such that the intermediate transfer belt 40 projects to its surface side (the toner image carrying surface side). The vibration preventing member 55 is fixedly supported by a transfer unit frame not shown to which the tension roller 41, the secondary transfer inner roller 42 and the driving roller 43 stretching the intermediate transfer belt 40 are assembled and by a frame not shown of the image forming apparatus body. The vibration preventing member 55 will be explained below with reference to FIG. 2. FIG. 2 is a schematic diagram illustrating the vibration preventing member 55.

The vibration preventing member 55, i.e., a press member, is formed into a plate-like shape by adopting a resin material such as polyester. For example, the vibration preventing member 55 is formed into a plate of 0.4 to 0.6 mm thick and 330 to 380 mm in total width that enables the vibration preventing member 55 to be totally in contact with the intermediate transfer belt 40 across a whole width thereof. In a case when the vibration preventing member 55 is formed by using a PET resin sheet, an electric current may flow through the vibration preventing member 55 along with the application of the secondary transfer voltage to the secondary transfer roller 10, possibly causing defective transfer, if electric resistance of the PET resin sheet is low. If a PET resin sheet whose electric resistance is high is adopted in contrary, static electricity (frictional electrification) may be generated by friction between the vibration preventing member 55 and the intermediate transfer belt 40, and the intermediate transfer belt 40 may be adsorbed to the vibration preventing member 55, possibly interfering the rotation of the intermediate transfer belt 40. Then, as the vibration preventing member 55, it is preferable to adopt a PET resin sheet which has been adjusted to have a medium range electric resistance in advance.

As shown in FIG. 2, the vibration preventing member 55 is disposed such that a tip 55*a* thereof is located at a position P distant upstream, in the rotation direction of the intermediate transfer belt 40, by a predetermined distance from an inlet C of the secondary transfer nip T2 (a distance O-C in FIG. 2). Specifically, the vibration preventing member 55 is disposed such that a distance D between the position P where the intermediate transfer belt 40 comes into contact with the tip 55*a* of the vibration preventing member 55 and the position C where the intermediate transfer belt 40 starts to contact with the secondary transfer roller 10 becomes 3 to 15 mm for example.

Such an intrusion amount of the vibration preventing member 55 that causes no gap between the recording medium B and the intermediate transfer belt 40 is determined in advance, and the vibration preventing member 55 is disposed at a level corresponding to the intrusion amount. The intrusion amount corresponds to a displacement length in a direction orthogonal to the rotation direction R2 of the intermediate transfer belt 40 from a stretched surface of the intermediate transfer belt 40 in a case where the intermediate transfer belt 40 is not pressed by the vibration preventing member 55 to a stretched surface of the intermediate transfer belt 40 in a case where the intermediate transfer belt 40 is pressed by the vibration preventing member 55. The vibration preventing member 55 is disposed at an arbitrary level (the position in the direction orthogonal to the rotation direction R2 of the intermediate transfer belt 40) such that the stretched surface of the intermediate transfer belt 40 projects by 1.0 to 3.0 mm for example to the surface side (the toner image carrying surface side).

The vibration preventing member 55 enables the recording medium B to adhere with the intermediate transfer belt 40 over 5 to 10 mm at upstream of the secondary transfer nip T2 by disposing the vibration preventing member 55 at the abovementioned position. It is noted that it is preferable to increase the intrusion amount of the vibration preventing member 55 in transferring a toner image to a recording medium B whose surface irregularity is large. The recording medium B comes into contact with the intermediate transfer belt 40 with high pressure if the intrusion amount of the vibration preventing member 55 increases, so that the irregularities on the surface of the recording medium B on the side in contact with the intermediate transfer belt 40 is smoothed and voids are hardly generated as a result.

Beside the vibration preventing member 55, a roller-like back-up roller 20 preventing vibrations of the intermediate transfer belt 40 is provided in the image forming apparatus 100 of the present embodiment. The back-up roller 20 is disposed so as to be in contact with the back surface of the intermediate transfer belt 40 at upstream, in the rotation direction of the intermediate transfer belt 40, of the vibration preventing member 55. The back-up roller 20 is provided to prevent the intermediate transfer belt 40 from otherwise vibrating when a front end of the recording medium B starts to come into contact with the intermediate transfer belt 40 or when a rear end of the recording medium B passes through the guides 14 and 15 and leaps and hits against the intermediate transfer belt 40.

By the way, there is a case when voids are generated even when the vibration preventing member 55 described above is provided in the conventional image forming apparatus 100 configured to guide the recording medium B delivered from the secondary transfer nip T2 by uplifting the front end by the conveying belt 61. The applicant et al. of the present invention confirmed by experiments that voids are generated by 40 μA of secondary transfer current when a print job was conducted by using a coated sheet of white A ivory+310 [g/m$^2$] (basis weight) manufactured by Oji Paper Co., Ltd. with a process speed of 300 mm/sec.

When the applicant et al. verified the cause of the voids based on the experimental result, it was found that the voids are started to be generated from timing when the coated sheet is placed on the conveying belt 61. That is, in a case of guiding a recording medium B whose bending rigidity is high such as a coated sheet, the rear end of the recording medium B moves in a direction of separating from the intermediate transfer belt 40 at upstream of the secondary transfer nip T2 if the front end of the recording medium B is uplifted at downstream of the secondary transfer nip T2 by the conveying belt 61. Then, it was concluded that the cause of the voids is a gap made between the intermediate transfer belt 40 and the recording medium B, which causes the abnormal discharge. That is, if a recording medium B' is guided to the intermediate transfer belt 40 side across an extension line S of a belt surface 40*a* of the intermediate transfer belt 40 formed by the secondary transfer nip T2 and the vibration preventing member 55, the gap M is made between the intermediate transfer belt 40 and the recording medium B' at upstream of the secondary transfer nip T2. Then, the voids can be generated by abnormal discharge occurring at a part where the gap M is made. It is noted that the recording medium B whose bending rigidity is high includes a thick sheet, a coated sheet, and an OHP sheet, whose basis weight is 82 g/m$^2$ or more.

Figure 3:
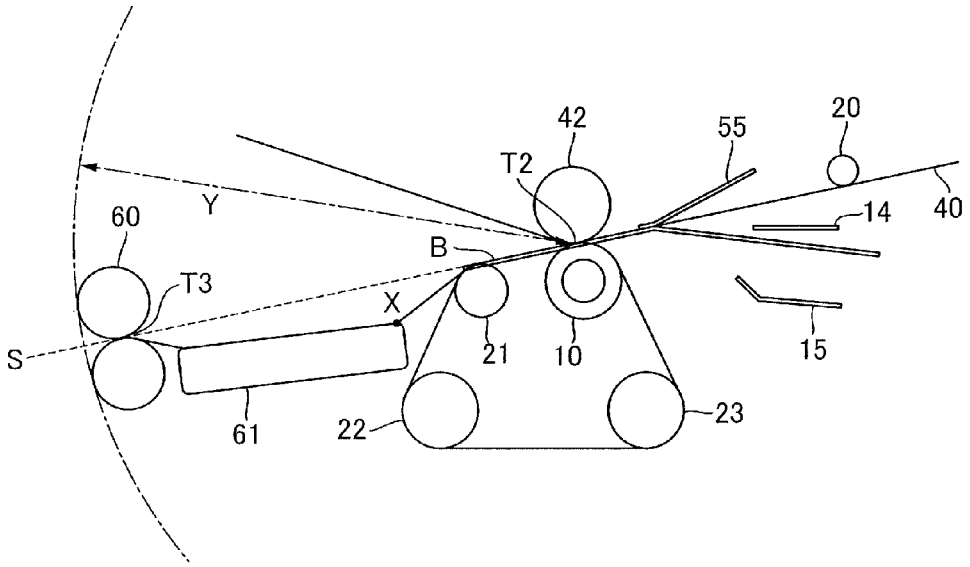
FIG. 3 illustrates positions where a fixing apparatus and a conveying belt of the embodiment are disposed.

In the image forming apparatus 100 of the present embodiment, the fixing apparatus 60 and the conveying belt 61 are disposed such that the recording medium B is guided on a side distant from the intermediate transfer belt 40 across the extension line S of the belt surface 40*a* (a surface O-P in FIG. 2) formed by the secondary transfer nip T2 and the vibration preventing member 55. This arrangement will be described by using FIG. 3 while making reference to FIG. 2. FIG. 3 illustrates positions where the fixing apparatus 60 and the conveying belt 61 are disposed. In order to facilitate understanding of the description, the description will be divided into a case when the fixing apparatus 60 is disposed within a range Y from the secondary transfer nip T2 (more specifically from an outlet O) to a maximum sheet passing length and into a case when the fixing apparatus 60 is disposed out of the range Y from the secondary transfer nip T2 to the maximum sheet passing length. It is noted that the disposed position of the fixing apparatus 60 is determined based on a fixing nip T3. The maximum sheet passing length is also determined to a predetermined value in advance corresponding to a printable maximum size such as 420 mm (A3 size) and 19 inch (A3 elongated size) per each type of image forming apparatus.

The case when the fixing apparatus 60 is disposed within the range Y from the secondary transfer nip T2 to the maximum sheet passing length will be described first. In this case, if the recording medium B of the maximum sheet passing length is fed, a front end of the recording medium B can reach the fixing nip T3 while the recording medium B is being nipped by the secondary transfer nip T2. As described above, the vibration preventing member 55 presses the intermediate transfer belt 40 from the back surface thereof and adheres the recording medium B with the intermediate transfer belt 40 across the range of 5 to 10 mm or more at upstream of the secondary transfer nip T2. Due to that, the recording medium B nipped by the secondary transfer nip T2 is delivered from the secondary transfer nip T2 to the conveying belt 61 side in a direction along the extension line S of the belt surface 40*a* formed by the secondary transfer nip T2 and the vibration preventing member 55 (see FIG. 2).

As shown in FIG. 3, both the fixing apparatus 60 and the conveying belt 61 are disposed at the positions distant from the intermediate transfer belt 40 across the extension line S of the belt surface 40*a*, i.e., not on the intermediate transfer belt 40 side but on the secondary transfer roller 10 side based on the extension line S of the belt surface 40*a*. The conveying belt 61 forms a series of guide paths (guide surfaces) X from the secondary transfer nip T2 (specifically from the outlet O) to the fixing apparatus 60 (specifically to the fixing nip T3). As it can be seen from FIG. 3, the guide path X from the secondary transfer nip T2 to the conveying belt 61 is not formed in a direction of intersecting with the extension line S of the belt surface 40*a*. Due to that, the recording medium B is not guided such that the front end thereof is uplifted within the range from the secondary transfer nip T2 to the conveying belt 61.

Meanwhile, the guide path X from the conveying belt 61 to the fixing apparatus 60 is formed in a direction of intersecting with the extension line S of the belt surface 40*a*. However, before the guide path X intersects with the extension line S of the belt surface 40*a*, the front end of the recording medium B arrives at the fixing apparatus 60. Therefore, the recording medium B will not be guided such that the front end thereof is uplifted in the range from the conveying belt 61 to the fixing apparatus 60.

By the way, if the fixing apparatus 60 is disposed on the intermediate transfer belt 40 side (the image carrying belt side) across the extension line S of the belt surface 40*a*, the guide path X from the conveying belt 61 to the fixing apparatus 60 comes to the fixing apparatus 60 after intersecting with the extension line S of the belt surface 40*a*. In that case, the front end of the recording medium B is uplifted along the guide path X and is guided to the fixing apparatus 60, the gap M is made between the intermediate transfer belt 40 and the recording medium B at upstream of the secondary transfer nip T2. That is, the voids could be generated. In view of the abovementioned circumstances, in the case when the fixing apparatus 60 is disposed within the range Y from the secondary transfer nip T2 to the maximum sheet passing length, not only the conveying belt 61 but also the fixing apparatus 60 is disposed at the positions distant from the intermediate transfer belt 40 across the extension line S of the belt surface 40*a*.

Next, the case when the fixing apparatus 60 is disposed out of the range Y from the secondary transfer nip T2 to the maximum sheet passing length will be described. In this case, when the recording medium B of the maximum sheet passing length is fed, a front end of the recording medium B cannot reach the fixing nip T3 even if a rear end of the recording medium B has arrived at the inlet C of the secondary transfer nip T2. The conveying belt 61 is disposed at the position distant from the intermediate transfer belt 40 across the extension line S of the belt surface 40*a* also in this case similarly to the case described above. Thereby, the recording medium B is not guided such that the front end thereof is uplifted within the range from the secondary transfer nip T2 to the conveying belt 61.

Meanwhile, differing from the case described above, the fixing apparatus 60 may not be disposed at the position distant from the intermediate transfer belt 40 across the extension line S of the belt surface 40*a*. In other words, the fixing apparatus 60 may be disposed on the intermediate transfer belt 40 side across the extension line S of the belt surface 40*a*. It is because no void can be generated even if the guide path X from the conveying belt 61 to the fixing apparatus 60 intersects with the extension line S of the belt surface 40*a*, differing from the case when the fixing apparatus 60 is disposed within the range Y from the secondary transfer nip T2 to the maximum sheet passing length.

That is, in this case, the guide path X from the conveying belt 61 to the fixing apparatus 60 intersects with the extension line S of the belt surface 40*a* out of the range Y from the secondary transfer nip T2 to the maximum sheet passing length. If the intersection of the guide path X with the extension line S is located out of the range Y from the secondary transfer nip T2 to the maximum sheet passing length, the recording medium B has been delivered entirely out of the secondary transfer nip T2 and is not nipped by the secondary transfer nip T2 at the time when the recording medium B arrives at the fixing apparatus 60. Therefore, even if the front end of the recording medium B is uplifted across the extension line S of the belt surface 40*a*, no gap M is generated between the intermediate transfer belt 40 and the recording medium B at upstream of the secondary transfer nip T2 and no void is generated.

Thus, in the case when the fixing apparatus 60 is disposed out of the range Y from the secondary transfer nip T2 to the maximum sheet passing length, it is determined whether or not the recording medium B is guided such that the front end thereof is uplifted to the intermediate transfer belt 40 side across the extension line S of the belt surface 40*a* depending on the disposition of the conveying belt 61. For instance, if a length from the secondary transfer nip T2 to the fixing apparatus 60 is 500 mm and a maximum sheet passing length is 482 mm, no void can be generated if the conveying belt 61 is disposed at the position distant from the intermediate transfer belt 40 across the extension line S of the belt surface 40*a* and voids can be generated if the conveying belt 61 is disposed on the intermediate transfer belt 40 side across the extension line S of the belt surface 40*a*.

It is noted that not only the fixing apparatus 60 but also the conveying belt 61 may not be disposed at the position distant from the intermediate transfer belt 40 across the extension line S of the belt surface 40*a* if the conveying belt 61 is disposed out of the range Y from the secondary transfer nip T2 to the maximum sheet passing length.

Still further, the disposition of the stretch roller 21 is also important in a case of the image forming apparatus configured to conduct an operation of secondary transfer to the recording medium B by the secondary transfer belt 12 shown in FIG. 1. The stretch roller 21 is also disposed at a position distant from the intermediate transfer belt 40 across the extension line S of the belt surface 40*a* similarly to the conveying belt 61. That is, if the stretch roller 21 is disposed on the intermediate transfer belt 40 side across the extension line S of the belt surface 40*a*, the recording medium B is guided such that the front end thereof is uplifted to the intermediate transfer belt 40 side across the extension line S of the belt surface 40*a* regardless of the dispositions of the fixing apparatus 60 and the conveying belt 61. In order to avoid this from happening, the stretch roller 21 is disposed at the position distant from the intermediate transfer belt 40 across the extension line S of the belt surface 40*a*. Thus, it is arranged such that a guide path formed by a belt surface of the secondary transfer belt 12 on a side facing to the intermediate transfer belt 40 stretched between the secondary transfer roller 10 and the stretch roller 21 does not intersect with the extension line S of the belt surface 40*a*.

As described above, in the image forming apparatus 100 of the present embodiment, the conveying belt 61 is disposed such that the recording medium B is guided on the side distant from the intermediate transfer belt 40 across the extension line S of the belt surface 40*a* formed by the secondary transfer nip T2 and the vibration preventing member 55. That is, the conveying belt 61 guides the recording medium B delivered from the secondary transfer nip T2 on the side distant from the intermediate transfer belt 40 across the extension line S of the belt surface 40*a* until when the rear end of the recording medium B reaches the inlet C of the secondary transfer nip T2. Thereby, the recording medium B delivered from the secondary transfer nip T2 is guided to the fixing apparatus 60 in a state in which the front end thereof is not uplifted. Accordingly, even in a case of guiding a recording medium B whose bending rigidity is high in particular, the rear end of the recording medium will not move in the direction of separating from the intermediate transfer belt 40 at upstream of the secondary transfer nip T2 starting from the secondary transfer nip T2. Therefore, because no gap is made between the intermediate transfer belt 40 and the recording medium B, it is possible to prevent the voids from otherwise being generated by the abnormal discharge which has been remarkable in guiding the recording medium whose bending rigidity is high.

It is noted that the image forming apparatus using the secondary transfer belt 12 has been disclosed as the transfer member in the embodiment described above, the present invention is not limited to that configuration. For instance, the image forming apparatus may be configured such that the secondary transfer can be made by forming the secondary transfer nip T2 only by the secondary transfer roller 10 without using the secondary transfer belt 12 as the transfer member. Still further, the image forming apparatus is not limited only to the horizontal conveying type image forming apparatus configured to guide the recording medium B in a horizontal direction with respect to an apparatus body ground contact surface as shown in FIG. 1 but may be a vertical conveying type image forming apparatus configured to guide the recording medium B in a vertical direction with respect to the apparatus body ground contact surface.

It is noted that the conveying belt 61 guiding the recording medium B from the secondary transfer nip T2 to the fixing apparatus 60 is not limited to be one. It is possible to dispose a plurality of conveying belts 61 between the secondary transfer nip T2 to the fixing apparatus 60 and to guide the recording medium B by them. Still further, while the conveying belt 61 has been described as a guide portion guiding the recording medium B from the secondary transfer nip T2 to the fixing apparatus 60, the present invention is not limited to such configuration. For instance, the guide portion may be a columnar conveying roller or a conveying guide just supporting and restricting a moving direction of the recording medium.

It is noted that the vibration preventing member 55 is not limited to be the plate-like sheet member, but may be a columnar roller member for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-078575, filed on Apr. 7, 2014 which is hereby incorporated by reference herein in its entirety.

What is claimed is:

1. An image forming apparatus comprising:

an endless image carrying belt moving while carrying a toner image;

a transfer rotating member forming a transfer nip with the image carrying belt and transferring the toner image from the image carrying belt to a recording medium;

a pressure member provided adjacent to and upstream of, with respect to a moving direction of the image carrying belt, the transfer nip and pressing the image carrying belt from an inner circumferential surface thereof; and a guide portion disposed downstream of, with respect to the moving direction of the image carrying belt, the transfer nip on a side opposite to the image carrying belt across an extension line of the stretch surface formed by the transfer nip and the pressure member upstream of the transfer nip, and guiding the recording medium conveyed downstream from the transfer nip.

2. The image forming apparatus according to claim 1, further comprising a conveying belt conveying the recording medium conveyed downstream from the transfer nip, the conveying belt being provided on the side opposite to the image carrying belt across the extension line, wherein the guide portion includes a belt surface of the conveying belt.

3. The image forming apparatus according to claim 1, further comprising a fixing portion including two rotating bodies that are in contact with each other and form a fixing nip for fixing the toner image to the recording medium while conveying the recording medium conveyed downstream from the transfer nip, the two rotating bodies being disposed such that the fixing nip is provided on the side opposite to the image carrying belt across the extension line.

4. The image forming apparatus according to claim 3, wherein the fixing nip is provided at a position where a front end of the recording medium does not reach in a state in which a rear end of the recording medium has arrived at an inlet of the transfer nip.

5. The image forming apparatus according to claim 1, wherein the transfer rotating member includes:

an endless transfer belt;

a transfer roller biased in a direction of the image carrying belt with the transfer belt between the transfer roller and the image carrying belt; and a stretch roller provided downstream of, with respect to the conveying direction of the recording medium, the transfer nip and on the side opposite to the image carrying belt across the extension line, and wherein the guide portion includes a stretched surface of the transfer belt formed between the transfer roller and the stretch roller.

* * * * *